US008093818B2

(12) United States Patent
Kim et al.

(10) Patent No.: US 8,093,818 B2
(45) Date of Patent: Jan. 10, 2012

(54) PLASMA DISPLAY AND VOLTAGE GENERATOR THEREOF

(75) Inventors: Jeong-Hoon Kim, Suwon-si (KR); Jung-Pil Park, Suwon-si (KR); Suk-Ki Kim, Suwon-si (KR); Sang-Chul Han, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 688 days.

(21) Appl. No.: 12/171,501

(22) Filed: Jul. 11, 2008

(65) Prior Publication Data

US 2009/0033232 A1 Feb. 5, 2009

(30) Foreign Application Priority Data

Aug. 2, 2007 (KR) ..... 10-2007-0077752

(51) Int. Cl.
*G09G 3/10* (2006.01)
*G09G 3/28* (2006.01)

(52) U.S. Cl. ..... 315/169.4; 345/60

(58) Field of Classification Search ..... 345/102, 345/204, 211–214, 60; 315/169.1–4
See application file for complete search history.

(56) References Cited

U.S. PATENT DOCUMENTS

| | | | | |
|---|---|---|---|---|
| 6,597,122 | B2 * | 7/2003 | Lee et al. | 315/169.3 |
| 2005/0134532 | A1 * | 6/2005 | Choi et al. | 345/60 |
| 2005/0184977 | A1 * | 8/2005 | Itoh et al. | 345/204 |
| 2005/0280024 | A1 * | 12/2005 | Kim et al. | 257/146 |
| 2005/0285820 | A1 * | 12/2005 | Inoue et al. | 345/67 |
| 2006/0267865 | A1 * | 11/2006 | Jeong et al. | 345/60 |
| 2007/0029942 | A1 * | 2/2007 | Jeong et al. | 315/169.4 |
| 2007/0085848 | A1 * | 4/2007 | Jeong et al. | 345/211 |

FOREIGN PATENT DOCUMENTS

| | | | |
|---|---|---|---|
| KP | 10-2005-0036229 | A | 4/2005 |
| KP | 10-0708862 | B1 | 4/2007 |
| KR | 2003-0031359 | | 4/2003 |
| KR | 10-2005-0012467 | | 2/2005 |
| KR | 10-0627415 | | 9/2006 |

(Continued)

OTHER PUBLICATIONS

Korean Patent Abstracts, Publication No. 1020030031359 A; Date of Publication: Apr. 21, 2003; in the name of Gwang Ho Jin.

(Continued)

*Primary Examiner* — Jacob Y Choi
*Assistant Examiner* — Henry Luong
(74) *Attorney, Agent, or Firm* — Christie, Parker & Hale, LLP

(57) ABSTRACT

A plasma display device including a plasma display panel (PDP), a temperature detector for detecting temperature of the PDP, a driver for applying a driving voltage to a scan electrode, and a controller for generating a control signal to control the driver according to the temperature. The driver includes a transistor and first and second resistors. The transistor is coupled between a first power source and the scan electrode. The first power source supplies a scan voltage to the scan electrode. At least one of the first resistor and the second resistor is a variable resistor having a resistance that varies according to the control signal of the controller. A low discharge due to high temperature can be reduced or prevented, and the number of power sources of the plasma display device can be reduced.

4 Claims, 10 Drawing Sheets

FOREIGN PATENT DOCUMENTS

KR 10-2008-0023454 3/2008

OTHER PUBLICATIONS

Korean Patent Abstracts, Publication No. 1020050012467 A; Date of Publication: Feb. 2, 2005; in the name of Ki Duck Cho et al.

Korean Patent Abstracts, Publication No. 100627415 B1; Date of Publication: Sep. 15, 2006; in the name Seong Joon Jeong et al.

Korean Patent Abstracts, Publication No. 1020080023454 A; Date of Publication: Mar. 14, 2008; in the name of Jeong Hoon Kim et al.

* cited by examiner

PLASMA DISPLAY AND VOLTAGE GENERATOR THEREOF

CROSS-REFERENCE TO RELATED APPLICATION

This application claims priority to and the benefit of Korean Patent Application No. 10-2007-0077752 filed in the Korean Intellectual Property Office on Aug. 2, 2007, the entire content of which is incorporated herein by reference.

BACKGROUND OF THE INVENTION (a) Field of the Invention

The present invention relates to a plasma display device and a voltage generator thereof.

(b) Description of the Related Art

A plasma display device is a flat panel display that uses plasma generated by a gas discharge to display characters or images. It includes a plasma display panel (PDP) wherein hundreds of thousands to millions of discharge cells (hereinafter referred to as cells) are arranged in a matrix format, depending on its size.

The plasma display device is driven by dividing one frame into a plurality of subfields, each having a weight. In this case, each subfield includes a reset period, an address period, and a sustain period in a temporal manner.

The reset period is for initializing the status of each cell so as to facilitate an addressing operation on the cell, and the address period is for performing an addressing operation so as to select turn-on/turn-off cells (i.e., cells to be turned on/off). The sustain period is for causing a discharge for displaying an image on the addressed cells.

In general, the reset period is formed of a rising period and a falling period. In this case, during the rising period of the reset period, a voltage of a scan electrode is gradually increased to a reset maximum voltage so as to form many wall charges in all the cells. After that, during the falling period of the reset period, the voltage of the scan electrode is gradually decreased to a reset minimum voltage to erase the wall charges so that a wall charge state of each cell becomes appropriate for the addressing operation in the address period. Then, during the addressing period, a scan pulse and an address pulse are respectively applied to a scan electrode and an address electrode of a turn-on cell so as to select the turn-on cell.

However, when a temperature of the plasma display device is high, characteristics of elements included in a driver, which applies a driving voltage to a plasma display panel (PDP), are changed. Particularly, a characteristic of a threshold voltage of a switch, which forms a path through which the voltage of the scan electrode is gradually decreased to the reset minimum voltage, is changed. In general, the threshold voltage of the switch, which forms the path through which a falling waveform is applied, is decreased at a high temperature. Therefore, a slope of the falling waveform becomes steeper at a high temperature than at room temperature. In addition, since wall charges in each cell become more active at a high temperature, more wall charges are erased at a high temperature than at room temperature. Accordingly, an address discharge may not be properly generated in the address period, thereby problematically causing a low discharge.

The above information disclosed in this Background section is only for enhancement of understanding of the background of the invention and therefore it may contain information that does not form the prior art that is already known in this country to a person of ordinary skill in the art.

SUMMARY OF THE INVENTION

Exemplary embodiments of a plasma display device capable of reducing or preventing a low discharge include a voltage generator capable of reducing the number of power sources in the plasma display device.

An exemplary embodiment of a plasma display device according to the present invention includes a plasma display panel (PDP) having a first electrode, a temperature detector for detecting temperature of the PDP, a driver for applying a driving voltage to the first electrode, and a controller for generating a control signal to control the driver according to the temperature detected by the temperature detector. In this case, the driver includes a first transistor, at least one first resistor, and at least one second resistor. The first transistor is coupled between a first power source and the first electrode. The first power source supplies a scan voltage to the first electrode. The at least one first resistor is coupled between the first electrode and a control electrode of the first transistor. The at least one second resistor is coupled between the control electrode of the first transistor and the first power source. At least one of the first resistor and the second resistor is a variable resistor having a resistance that varies according to the control signal of the controller.

A voltage generator according to another exemplary embodiment of the present invention generates a second voltage that is greater than a first voltage by using a power source that supplies the first voltage, and includes a transistor, at least one first resistor, and at least one second resistor. The transistor has a first electrode coupled to the power source. The at least one first resistor is coupled between a control electrode of the transistor and a second electrode of the transistor. The at least one second resistor is coupled between the first electrode of the transistor and the control electrode of the transistor. At least one of the first resistor and the second resistor is a variable resistor that has a resistance that varies according to an external control signal, and the second voltage is applied to the second electrode of the transistor.

DETAILED DESCRIPTION OF EXEMPLARY EMBODIMENTS

Figure 1:
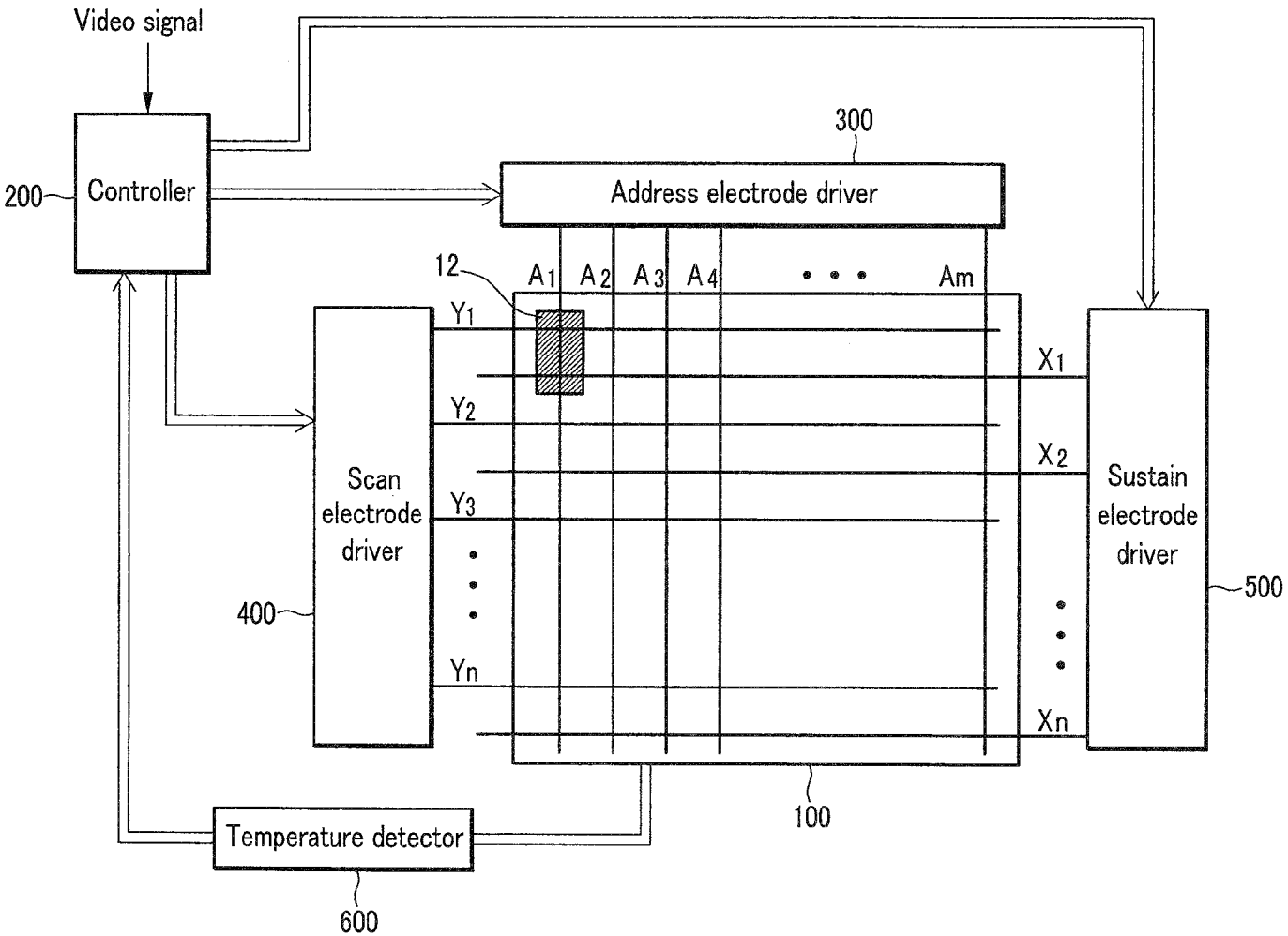
FIG. 1 is a schematic diagram of a plasma display device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

In addition, unless explicitly described to the contrary, the word "comprise" and variations such as "comprises" or "comprising" will be understood to imply the inclusion of stated elements but not necessarily the exclusion of any other elements.

Throughout this specification and the claims that follow, the wall charge refers to a charge that is formed on a wall (for example, a dielectric layer) of the discharge cell close to the electrodes to be stored in the electrode. Even though the wall charge is not actually in contact with the electrode, hereinafter it may be described that the wall charge is formed, accumulated, or stacked on the electrode. Further, the wall voltage refers to a potential difference generated on the wall of the discharge cell by the wall charge.

Throughout this specification and the claims that follow, when it is described that an element is "coupled" to another element, the element may be "directly coupled" to the other element or "electrically coupled" to the other element through a third element.

Also, throughout this specification and the claims that follow, the following phrase: "at least one of the first element or the second element," shall mean any of "the first element," "the second element," or "the first and second elements."

When it is described in the specification that a voltage is maintained, it should not be understood to strictly imply that the voltage is maintained exactly at a predetermined voltage. To the contrary, even if a voltage difference between two points varies, the voltage difference is expressed to be maintained at a predetermined voltage in the case that the variance is within a range allowed in design constraints or in the case that the variance is caused due to a parasitic component that is usually disregarded by a person of ordinary skill in the art.

Hereinafter, a plasma display device and a driving method thereof according to an exemplary embodiment of the present invention will be described in further detail with reference to the accompanying drawings.

FIG. 1 shows a schematic diagram of the plasma display device according to the exemplary embodiment of the present invention.

As shown in FIG. 1, the plasma display device includes a plasma display panel (PDP) 100, a controller 200, an address electrode driver 300, a scan electrode driver 400, a sustain electrode driver 500, and a temperature detector 600.

The PDP 100 includes a plurality of address electrodes A1 to Am extending in a column direction, and a plurality of sustain electrodes X1 to Xn and a plurality of scan electrodes Y1 to Yn extending in a row direction. The sustain electrodes X1 to Xn are formed respectively corresponding to the scan electrodes Y1 to Yn, and the address electrodes A1 to Am are arranged to cross the sustain electrodes X1 to Xn and the scan electrodes Y1 to Yn. A discharge space at a crossing region of the address electrodes A1 to Am and the scan and sustain electrodes Y1 to Yn and X1 to Xn forms a discharge cell 12. This structure of the PDP 100 is merely exemplary, and panels of other structures can be used in the present invention.

The controller 200 receives external video signals and outputs an address electrode driving control signal, a sustain electrode driving control signal, and a scan electrode driving control signal. In addition, the controller 200 divides one frame into a plurality of subfields. Each subfield has a reset period, an address period, and a sustain period in a temporal manner. The controller 200 according to the exemplary embodiment of the present invention outputs a control signal for generating a $\Delta V$ voltage to the scan electrode driver 400 so as to prevent a low discharge from being generated when a temperature of the plasma display device, detected by the temperature detector 600, is greater than a reference temperature. That is, the controller 200 controls the scan electrode driver 400 to generate a high $\Delta V$ voltage at a high temperature so as to erase a lesser amount of wall charges formed in each cell during the reset period.

The address electrode driver 300 receives the address electrode driving control signal from the controller 200 and applies a display data signal to each address electrode so as to select a cell to be displayed.

The scan electrode driver 400 receives the scan electrode driving control signal from the controller 200 and applies a driving voltage to the scan electrode.

The sustain electrode driver 500 receives a sustain electrode driving control signal from controller 200 and applies a driving voltage to the sustain electrode.

In addition, the temperature detector 600 detects the temperature of the plasma display device and transmits the detected temperature to the controller 200.

Figure 2:
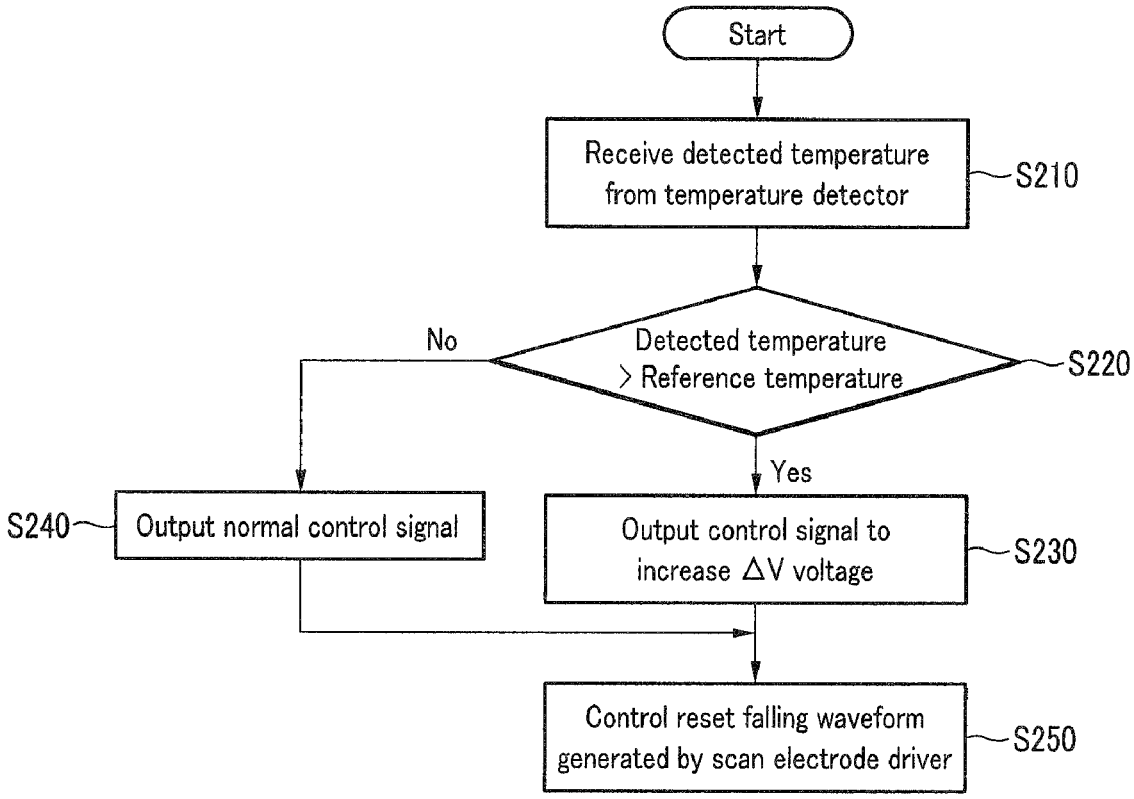
FIG. 2 is a flow chart describing operation of a controller of FIG. 1.

FIG. 2 is a flowchart illustrating the operation of the controller 200 of FIG. 1.

As shown in FIG. 2, the controller 200 receives the temperature of the plasma display device, detected by the temperature detector 600, in step S210, and compares the detected temperature with a reference temperature (which may have been predetermined) in step S220.

When the detected temperature is greater than the reference temperature (i.e., when the temperature of the plasma display device is high), the controller 200 outputs a control signal for setting a reset minimum voltage to a high voltage level that is higher than a room temperature voltage level so as to increase a $\Delta V$ voltage, in step S230.

When the detected temperature of the plasma display device is less than the reference temperature (i.e., when the temperature of the plasma display device is room temperature), the controller 200 outputs a normal control signal for setting the reset minimum voltage to the room temperature voltage level, in step S240.

Accordingly, the control signal output from the controller 200 is input to the scan electrode driver 400 to control a reset falling waveform applied to the scan electrode in step S250.

The reference temperature in FIG. 2 is a temperature that causes the slope of the reset falling waveform to be steeper due to variations of a characteristic of an element of a driver when the normal control signal is output from the controller 200, or a temperature that causes an address operation to be improperly performed because too many wall charges are to be erased due to active wall charges. The reference temperature may be experimentally obtained, and a method for obtaining the reference temperature is well known to a person of ordinary skill in the art, and therefore detailed descriptions thereof will be omitted.

A driving waveform of the plasma display device according to the exemplary embodiment of the present invention will be described with reference to FIG. 3.

Figure 3:
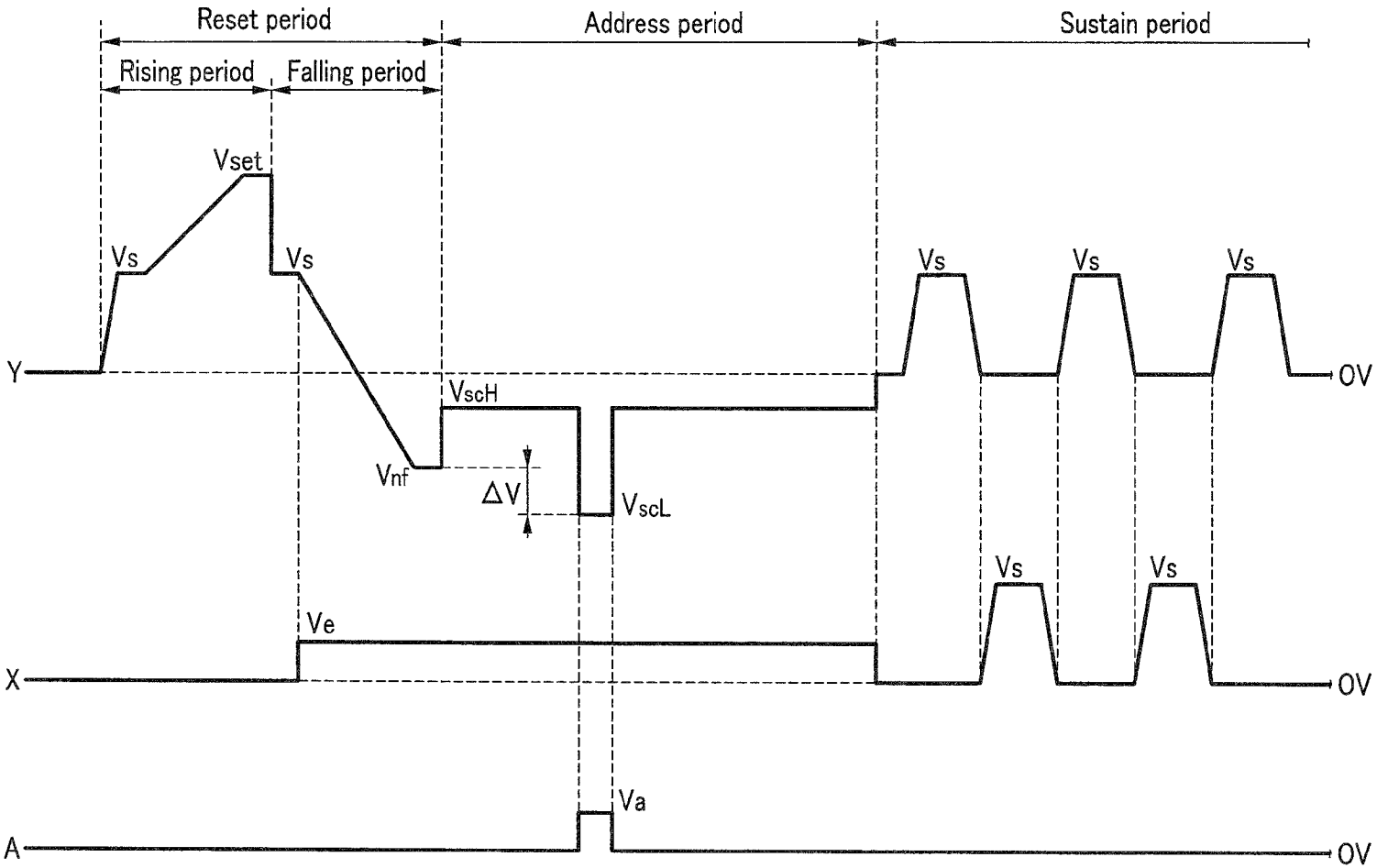
FIG. 3 is a waveform diagram showing a driving waveform of the plasma display according to the exemplary embodiment of the present invention.

FIG. 3 shows a driving waveform of the plasma display device according to the exemplary embodiment of the present invention. Hereinafter, a driving waveform applied to a scan electrode (hereinafter referred to as a Y electrode), a sustain electrode (hereinafter referred to as an X electrode), and an address electrode (hereinafter referred to as an A electrode) forming one cell will be described for convenience of description.

As shown in FIG. 3, one subfield includes a reset period, an address period, and a sustain period. and the reset period includes a rising period and a falling period.

During the rising period of the reset period, a rising waveform that gradually increases a voltage of the Y electrode from a Vs voltage to a Vset voltage (i.e., reset maximum voltage) is applied to the Y electrode while maintaining the A electrode and the X electrode at a reference voltage (0V voltage of FIG. 3). In this case, it is illustrated in FIG. 3 that the voltage of the Y electrode increases in a ramp pattern. While the voltage of the Y electrode is increased, a weak discharge is generated between the Y and X electrodes and between the Y and A electrodes so that negative (−) wall charges are formed on the Y electrode and positive (+) wall charges are formed on the A electrode. Since all cells need to be reset during the reset period, the Vset voltage is a voltage that is high enough to cause all the cells to experience a discharge under basically any condition. In addition, the Vs voltage generally equals a voltage applied to the Y electrode during the sustain period, and it is less than a discharge firing voltage between the Y electrode and the X electrode.

Subsequently, during the falling period of the reset period, a falling waveform that gradually decreases the voltage of the Y electrode from the Vs voltage to a Vnf voltage (i.e., reset minimum voltage) is applied to the Y electrode while the A electrode and the X electrode are respectively biased with the reference voltage and a Ve voltage. Then, a weak discharge is generated between the Y and X electrodes and the Y and A electrodes while the voltage of the Y electrode is decreased so that the negative (−) wall charges formed on the Y electrode and the positive (+) wall charges formed on the X and A electrodes are erased. In general, the Vnf voltage is set close to a discharge firing voltage between the Y electrode and the X electrode. Thereby, since a wall voltage between the Y electrode and the X electrode becomes close to the 0V voltage, a misfire (i.e., misfire between the Y electrode and the X electrode) may be reduced or prevented during the sustain period in a cell in which no address discharge is generated during the address period. In addition, since the A electrode is maintained at the reference voltage, a wall voltage between the Y electrode and the A electrode is determined by a level of the Vnf voltage.

During the address period, a scan pulse having a VscL voltage (i.e., scan voltage) and an address pulse having a Va voltage are respectively applied to the Y electrode and the A electrode so as to select a cell to be turned on (i.e., turn-on cell) while the X electrode is maintained at the Ve voltage. A Y electrode of an unselected cell is biased with a VscH voltage (i.e., non-scan voltage) that is greater (or more positive) than the VscL voltage, and an A electrode of the unselected cell is applied with a reference voltage (0V voltage in FIG. 3). Then, an address discharge is generated in a cell formed by the A electrode to which the Va voltage is applied and the Y electrode to which the VscL voltage is applied so that positive (+) wall charges are formed on the Y electrode and negative (−) wall charges are formed on the A electrode and the X electrode. In order to perform such an operation, the scan electrode driver 400 selects a Y electrode to which the scan pulse is applied among the Y electrodes Y1 to Yn. For example, vertically arranged Y electrodes may be sequentially selected. When one of the Y electrodes is selected, the address driver 200 selects an address electrode to which the address pulse is applied among the A electrodes A1 to Am that pass a cell formed by the selected Y electrode.

In further detail, the scan pulse is applied to a scan electrode (Y1 of FIG. 1) of the first row, and at the same time the address pulse is applied to an A electrode that passes a turn-on cell of the first row. Then, a discharge is generated between the Y electrode of the first row and the A electrode to which the Va voltage is applied so that positive (+) wall charges are formed on the Y electrode and negative (−) wall charges are formed on the A electrode and the X electrode. As a result, a wall voltage Vwxy is formed between the Y electrode and the X electrode such that the potential of the Y electrode is higher than the potential of the X electrode. Subsequently, the address pulse is applied to an A electrode that forms a cell to be displayed among cells in the second row while applying the scan pulse to a Y electrode (Y2 of FIG. 1) of the second row. Then, as previously described, an address discharge is generated between the A electrode to which the Va voltage is applied and the Y electrode of the second row so that wall charges are formed at a cell. In a manner like the above, an address discharge is generated by applying the address pulse having the Va voltage to an A electrode that forms a turn-on cell while sequentially applying the scan pulse having the VscL voltage to Y electrodes of other rows.

During the sustain period, a sustain pulse of a high level voltage (Vs) and a sustain pulse of a low level voltage (0V) are alternately applied to the Y electrode and the X electrode while having reverse phases. Then, a sustain discharge is generated in a cell selected in the address period. In this case, an operation for alternately applying the sustain pulses of the high level voltage and the low level voltage to the Y electrode and the X electrode is repeated a number of times corresponding to a weight of the corresponding subfield.

According to the exemplary embodiment of the present invention, a scan voltage (i.e., VscL voltage) is less (or more negative) than a reset final voltage (i.e., Vnf voltage) applied to the Y electrode during the reset period by ΔV voltage. By setting the scan voltage (i.e., VscL voltage) to be less than the Vnf voltage, a low discharge can be prevented from being generated in the next address period.

In further detail, when the Vnf voltage is applied to the Y electrode, a sum of a wall voltage Vway between the A electrode and the Y electrode and an externally applied voltage (i.e., Vnf) between the A electrode and the Y electrode corresponds to a discharge firing voltage Vfay between the A electrode and the Y electrode. When the 0V voltage is applied to an A electrode of a cell that was not selected in the address period and the VscL voltage is applied to the Y electrode, a voltage that is greater than the discharge firing voltage Vfay is formed, thereby causing a discharge to be generated. However, in general, a discharge delay time is greater than the width of the scan pulse so that the discharge is not generated. When the Va voltage is applied to an A electrode of a turn-on cell and the VscL voltage is applied to the Y electrode, a voltage that is greater than the Vfay voltage is formed between the A electrode and the Y electrode so that the discharge delay time may become less than the width of the scan pulse and the width of the address pulse, thereby causing a discharge to be generated. When the scan voltage that equals the Vnf voltage is applied to the Y electrode, a voltage higher than the Vfay voltage may be formed between the A electrode and the Y electrode so that the discharge may be generated. However, when the VscL voltage that is less than the Vnf voltage by the ΔV voltage is applied to the Y electrode, a voltage difference between the A electrode and the Y electrode is increased so that the discharge delay time can be reduced according to the present embodiment. Accordingly, the address discharge can be more efficiently generated, thereby preventing the low discharge from being generated. That is, according to the exemplary embodiment of the present invention, the scan voltage that is less than the reset final voltage by the ΔV voltage is applied to the Y electrode so as to prevent the low discharge from being generated at room temperature. In FIG. 3, the ΔV voltage is a voltage that is applied in accordance with the normal control signal at room temperature.

When the temperature of the plasma display device is higher than room temperature, the voltage of the Y electrode may be gradually decreased from the Vs voltage to the Vnf voltage with a steep slope during the falling period of the reset period. This is because, in a driving circuit of the scan electrode driver 400, characteristics of a transistor, which forms a path through which a voltage decreased to the Vnf voltage is applied to the Y electrode, are changed at a high temperature. Characteristics of an element (e.g., a capacitor) in a ramp circuit that generates a ramp waveform applied to the Y electrode during the falling period of the reset period are changed at the high temperature. In addition, since wall charges in the PDP are more active at the high temperature, many more wall charges are erased during the falling period of the reset period. That is, when the voltage of the Y electrode is decreased to the Vnf voltage of room temperature at the high temperature as shown in FIG. 3, a relatively larger amount of charges are erased than at room temperature so that the address operation may not be properly performed in the next address period.

Therefore, according to the exemplary embodiment of the present invention, the temperature of the plasma display device is detected and the ΔV voltage is controlled (e.g., automatically controlled) in accordance with the detected temperature to thereby prevent a low discharge from being generated at the high temperature. In this case, the ΔV voltage is set to be higher at the high temperature than at room temperature.

A driving circuit that controls the ΔV voltage according to temperature and a driving method thereof according to the exemplary embodiment of the present invention will be described in further detail with reference to FIG. 4 to FIG. 7.

Figure 4:
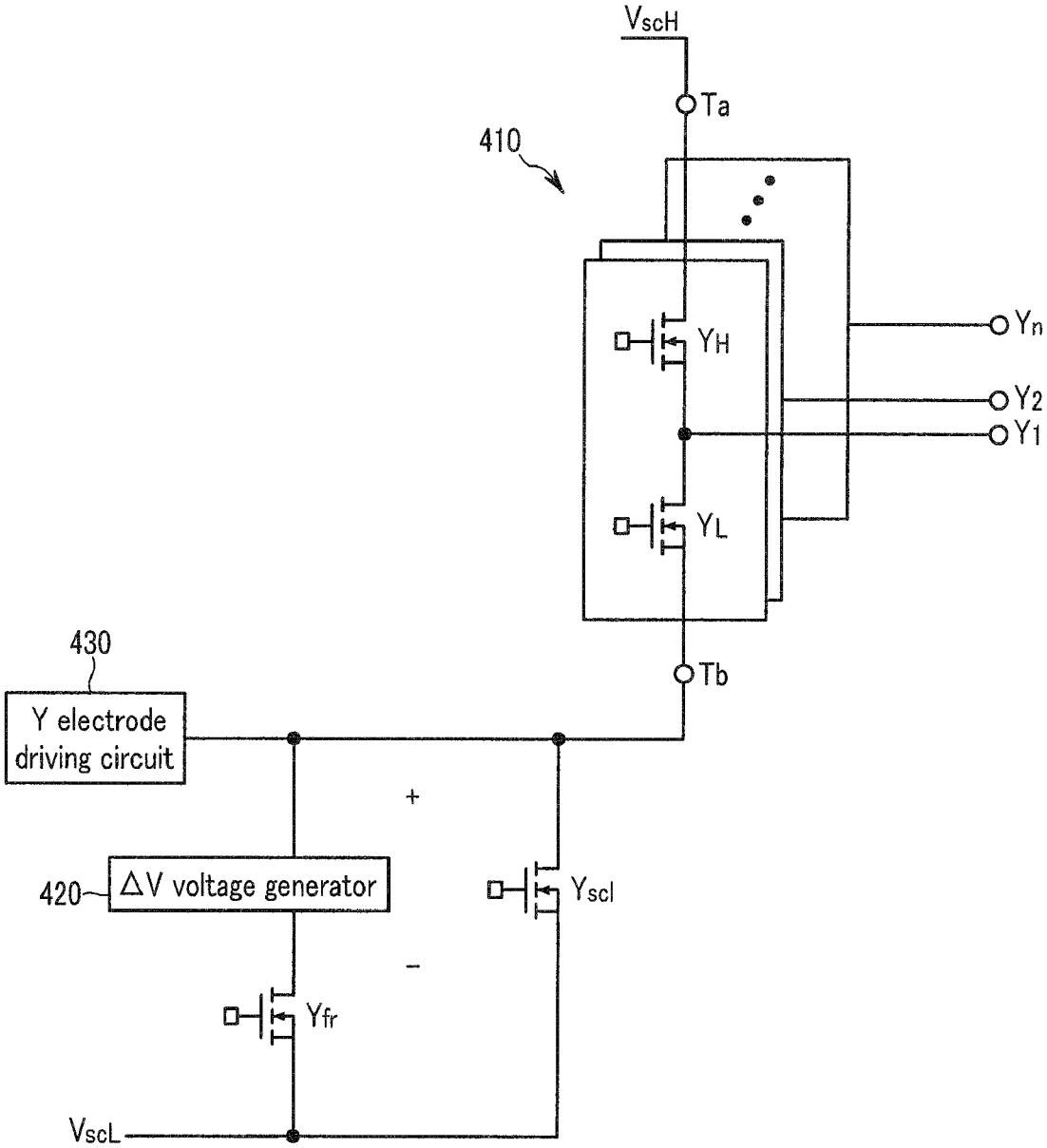
FIG. 4 is a simplified schematic diagram of a scan electrode driver according to the exemplary embodiment of the present invention.

FIG. 4 is a simplified schematic diagram of the scan electrode driver 400 according to the exemplary embodiment of the present invention.

As shown in FIG. 4, the scan electrode driver 400 includes a plurality of scan ICs 410, a ΔV voltage generator 420, transistors Yfr and Yscl, and a Y electrode driving circuit 430. In FIG. 4, each transistor is illustrated as an n-channel field effect transistor, particularly as an n-channel metal oxide semiconductor (NMOS), and a body diode is formed in a direction from a source to a drain of each transistor. Instead of the NMOS transistor, other transistors having similar functions to the NMOS transistor may be provided as the transistors Yfr and Yscl. In addition, in FIG. 4, each transistor is illustrated as one transistor, but it may be formed as a plurality of transistors connected in parallel.

Each of the plurality of scan ICs 410 includes a transistor $Y_H$, a transistor $Y_L$, a Ta terminal, and a Tb terminal. Therein, a drain of the transistor $Y_H$ is connected to the Ta terminal and a source of the transistor $Y_L$ is connected to the Tb terminal. A source of the transistor $Y_H$ and a drain of the transistor $Y_L$ are connected to each other, and a node therebetween is connected to the respective scan electrodes Y1 to Yn. In addition, a VscH voltage from a power source VscH is applied to the Ta terminal. A drain of the transistor Yscl is connected to the Tb terminal of each of the plurality of scan ICs 410, and a source of the transistor Yscl is connected to a power source VscL that supplies the VscL voltage.

The ΔV voltage generator 420 is connected between the Tb terminal and a drain of the transistor Yfr, and a source of the transistor Yfr is connected to the power source VscL that supplies the VscL voltage. In this case, a gate of the transistor Yfr is connected with a ramp circuit for gradually decreasing the voltage of the Y electrode. A method for gradually decreasing the voltage of the Y electrode through the transistor Yfr is well known to a person of ordinary skill in the art, and therefore no further description will be provided. In addition, the ΔV voltage generator 420 according to the exemplary embodiment of the present invention generates the ΔV (i.e., Vnf−VscL) voltage of FIG. 3 without using an additional power source. A configuration of the ΔV voltage generator 420 will be described in further detail later with reference to FIG. 5 to FIG. 8.

The Y electrode driving circuit 430 is connected to the Y electrode through the Tb terminal, and generates various driving waveforms (e.g., a rising waveform of the reset period and a sustain discharge pulse) applied to the Y electrode. Configurations of the Y electrode driving circuit 430 and a driving circuit (not shown) for applying a non-scan voltage (i.e., VscH voltage) to the Y electrode during the address period are not required for a complete understanding of the present invention, and therefore detailed descriptions thereof will be omitted.

During the falling period of the reset period, the transistor Yfr and the transistor $Y_L$ of each of the plurality of scan ICs 410 are turned on, and the voltage of the Y electrode is gradually decreased to the Vnf voltage (i.e., (VscL+ΔV) voltage) by the ΔV voltage generator 420. That is, when the transistor Yfr is turned on, the voltage of the Y electrode is added with the VscL voltage and the ΔV voltage generated by the ΔV voltage generator 420, so that the voltage of the Y electrode is gradually decreased to the Vnf voltage (i.e., (VscL+ΔV) voltage).

In addition, during the address period, the transistor Yscl is turned on and a transistor $Y_L$ of a scan IC that corresponds to a Y electrode to be selected so that the scan voltage (i.e., VscL voltage) is applied to the corresponding Y electrode. In this case, the transistor $Y_H$ is turned on and a scan IC that corresponds to an unselected Y electrode is applied with the VscH voltage.

Hereinafter, the ΔV voltage generator 420 that generates a ΔV voltage difference will be described in further detail with reference to FIG. 5 to FIG. 8.

Figure 5:
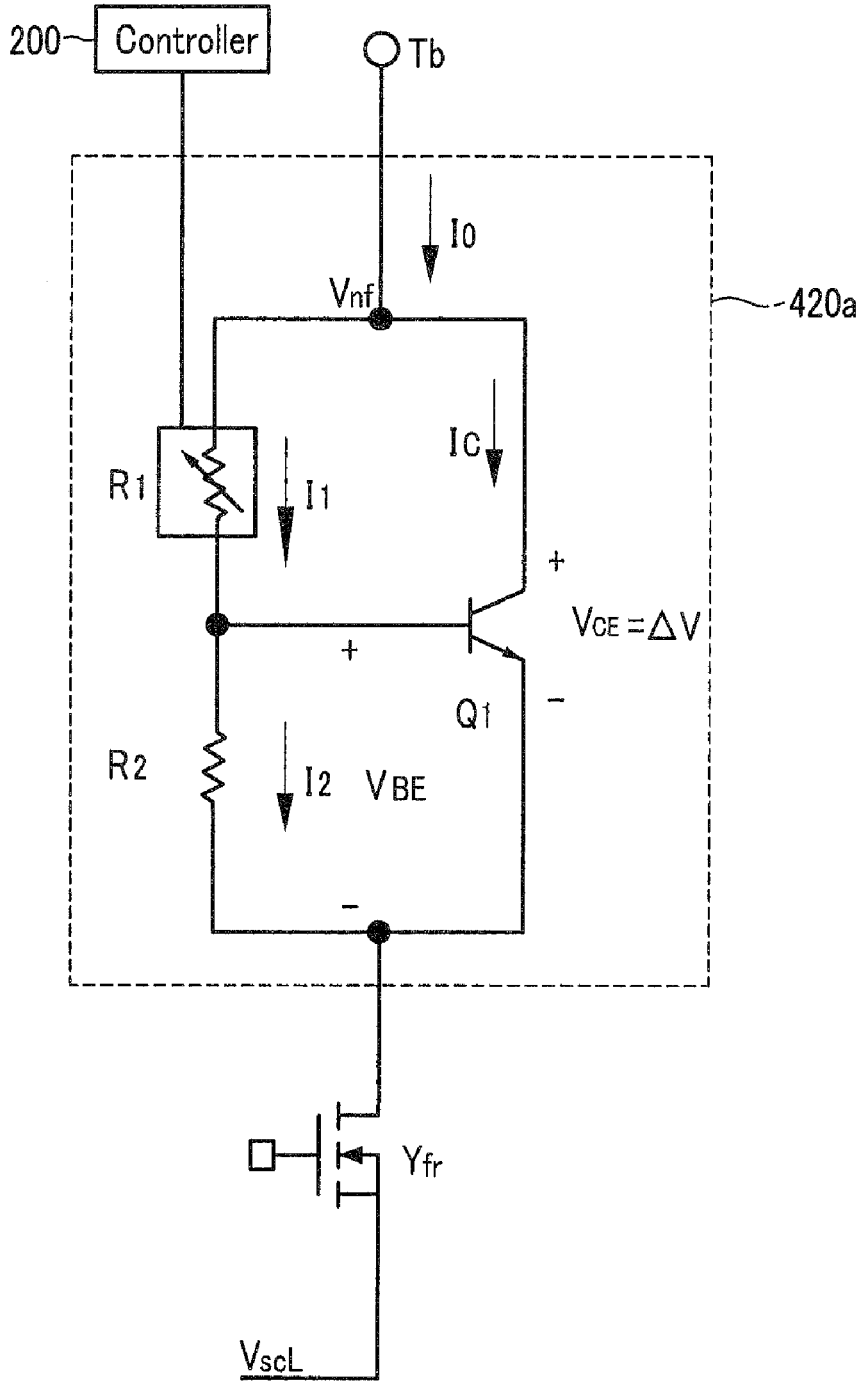
FIG. 5 is a simplified schematic diagram of a ΔV voltage generator according to a first exemplary embodiment of the present invention.
Figure 6A:
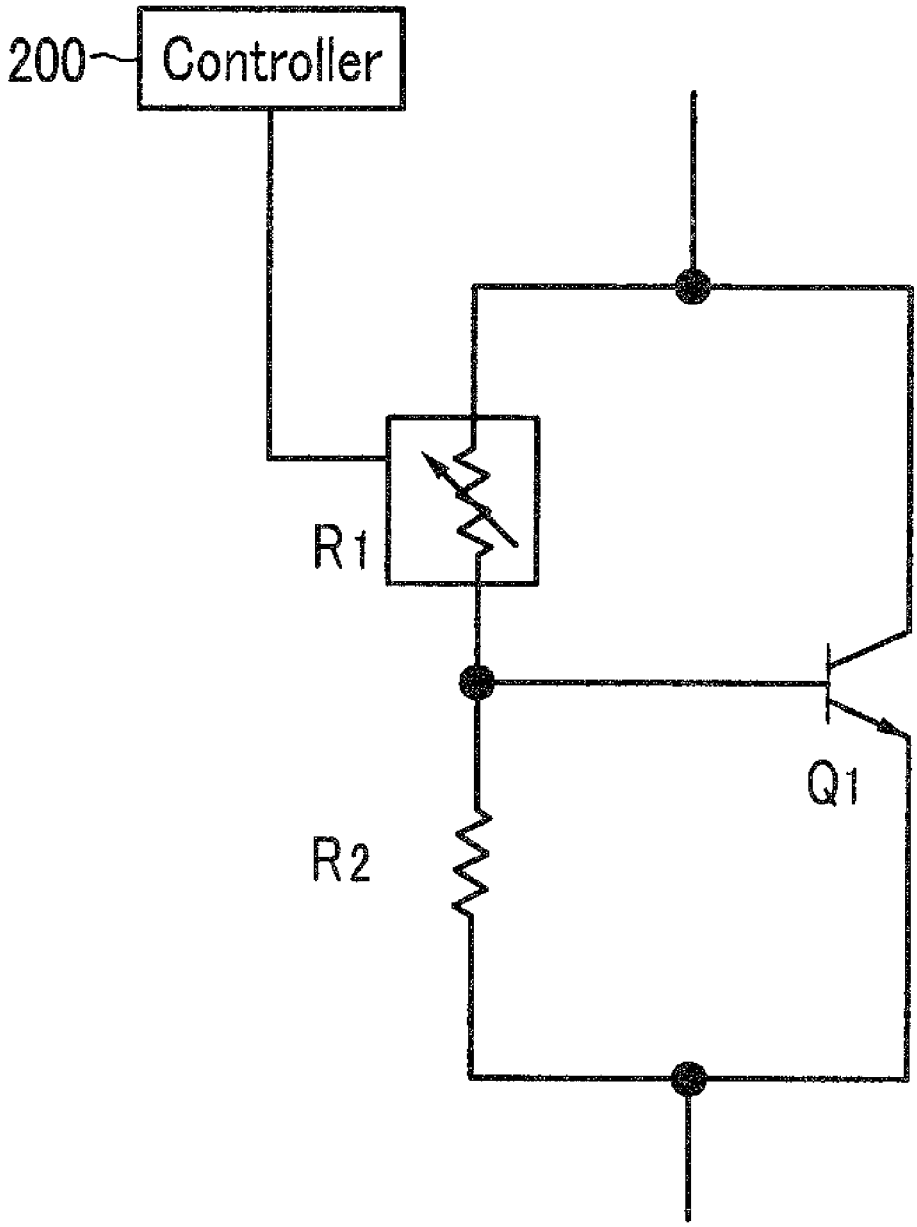
FIG. 6A to 6C are simplified schematic diagrams of the ΔV voltage generator of FIG. 5 having at least one resistor formed of a variable resistor.
Figure 6B:
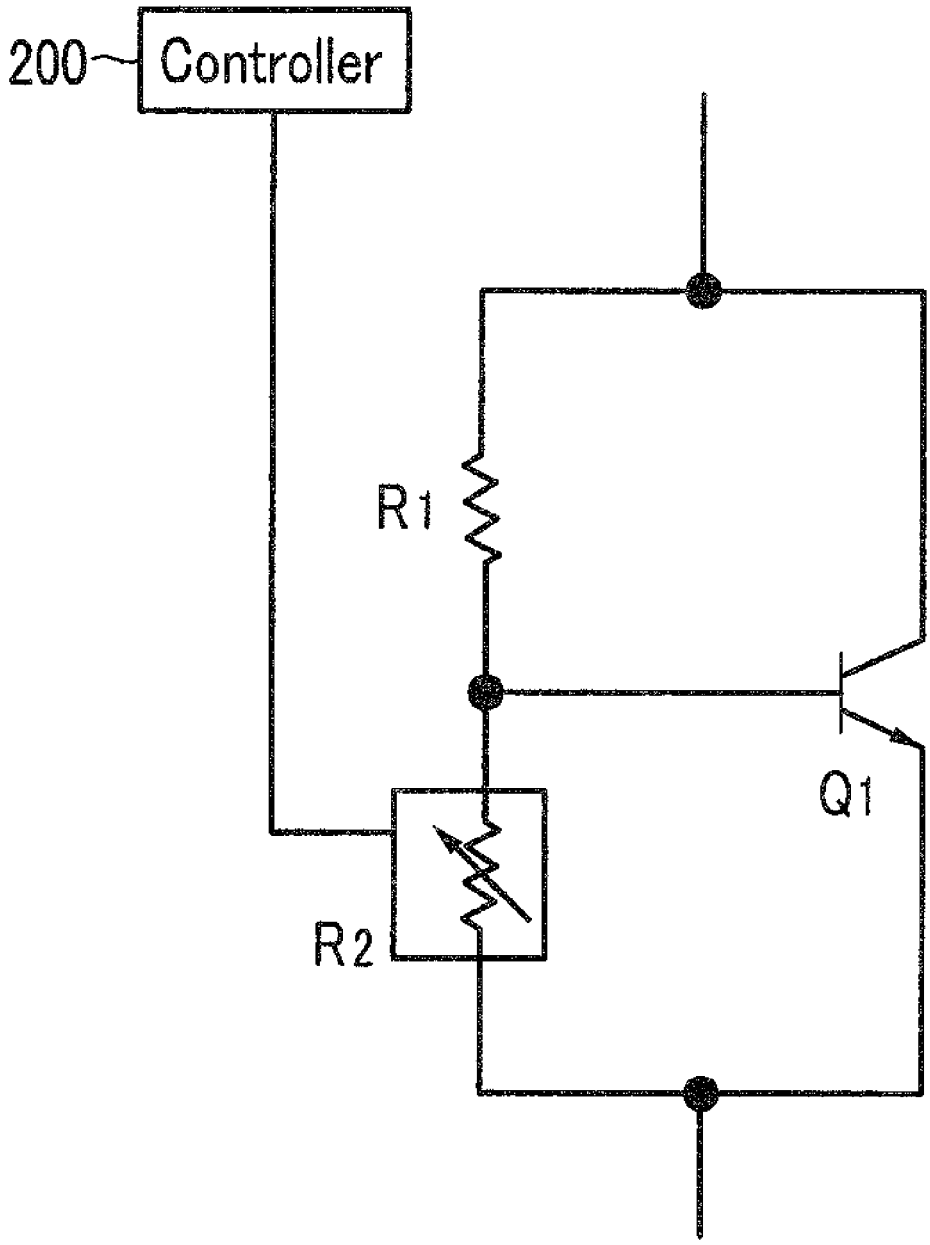
Figure 6C:
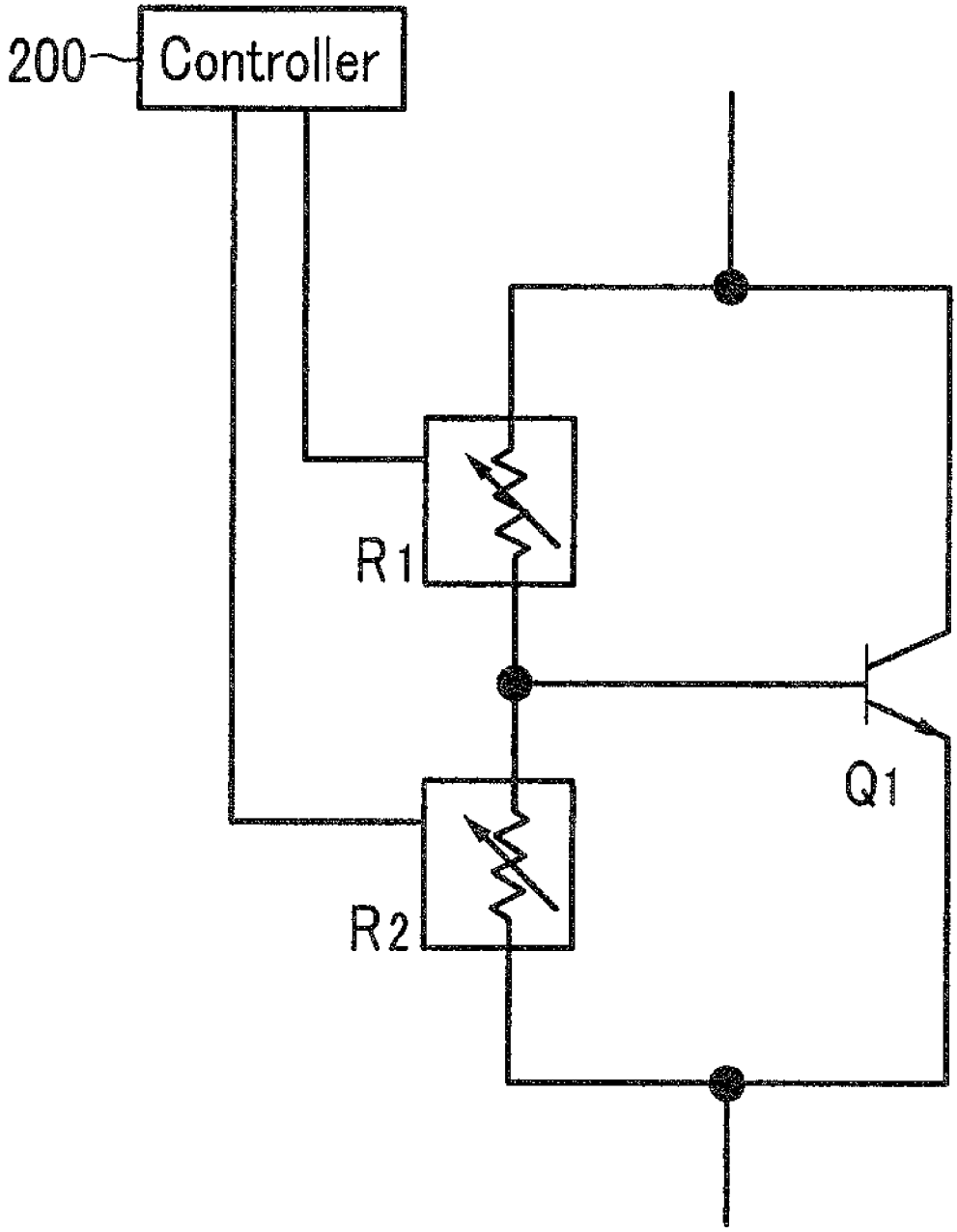

FIG. 5 is a simplified schematic diagram of a ΔV voltage generator 420*a* according to a first exemplary embodiment of the present invention. FIG. 6A to 6C respectively show cases that at least one resistor of the ΔV voltage generator of FIG. 5 is provided as a variable resistor.

As shown in FIG. 5, the ΔV voltage generator 420*a* includes a transistor Q1 and resistors R1 and R2. Herein, the transistor Q1 is provided as a bipolar transistor.

A collector of the transistor Q1 is connected to the Tb terminal of each of the plurality of scan ICs 410, and an emitter of the transistor Q1 is connected to the drain of the transistor Yfr. A first end of the resistor R1 is connected to the collector (i.e., Tb terminal) of the transistor Q1 and a second end is connected to a base of the transistor Q1. A first end of the resistor R2 is connected to the base of the transistor Q1 and a second end is connected to the emitter of the transistor Q1. That is, the resistor R1 and the resistor R2 are connected to each other, and a node therebetween is connected to the base of the transistor Q1.

In this case, when the amount of current Io is small, the transistor Q1 is turned off so that the current Io flows only to the resistors R1 and R2. When the current Io can turn on the transistor Q1, the current Io flows not only to the resistors R1 and R2 but also to the transistor Q1. In this case, a collector-emitter voltage $V_{CE}$ of the transistor Q1 can be obtained as given in Equation 1.

$$V_{CE}=I1*R1+I2*R2 \quad \text{Equation 1}$$

In Equation 1, when a base current of the transistor Q1 is ignored, I1≈I2, and the current I2 becomes $V_{BE}$/R2. Therefore, the collector-emitter voltage $V_{CE}$ of the transistor Q1 can be obtained as given in Equation 2.

$$V_{CE}=(1+R1/R2)*V_{BE} \quad \text{Equation 2}$$

Herein, the collector-emitter voltage $V_{CE}$ of the transistor Q1 is the ΔV voltage generated by the ΔV voltage generator 420*a*. Referring to Equation 2, the collector-emitter voltage $V_{CE}$ of the transistor Q1 can be set to a desired level in proportion to a base-emitter voltage $V_{BE}$ of the transistor Q1 by controlling a size ratio of the resistors R1 and R2.

That is, the ΔV voltage generator 420*a* according to the exemplary embodiment of the present invention can generate the ΔV value (=$V_{CE}$) of Equation 2. In this case the ΔV value can be determined by the size of resistors R1 and R2 and the base-emitter voltage $V_{BE}$ of the transistor Q1. Therefore, when the base-emitter voltage $V_{BE}$ of the transistor Q1 is a voltage that may be predetermined in accordance with characteristics of the transistor Q1, a desired ΔV value can be set by changing the values of the resistors R1 and R2.

Therefore, in the first exemplary embodiment of the present invention, at least one of the resistors R1 and R2 is provided as a variable resistor rather than a fixed resistor. In FIG. 5, the resistor R1 is provided as a variable resistor. In this case, the resistor R1 as a variable resistor (e.g., a digital resistor) has a resistance that varies according to a control signal of the controller 200. That is, the desired ΔV value can be set by changing the resistance of the resistor R1 according to the control signal when the temperature of the plasma display device is high. In this case, the controller according to the exemplary embodiment of the present invention compares the temperature of the plasma display device that is detected by the temperature detector 600 with the reference temperature and determines that the temperature of the plasma display device is high when the detected temperature is higher than the reference temperature. After that, the controller 200 outputs a control signal to the ΔV voltage generator 420*a* for setting a value of the resistor R1 of the ΔV voltage generator 420*a* when the temperature of the plasma display device is high.

Although the resistor R1 is provided as the automatic variable resistor in FIG. 5, at least one of the resistors R1 and R2 may be provided as the automatic variable resistor as shown in FIG. 6A to FIG. 6C.

In further detail, the value of the resistor R1 of the ΔV voltage generator 420*a* is set to be greater when the temperature of the plasma display device is high than when the temperature of the plasma display device is room temperature. That is, referring to Equation 2, the collector-emitter voltage $V_{CE}$=ΔV of the transistor Q1 increases when the value of the resistor R1 among the resistors R1 and R2 increases. Therefore, as shown in FIG. 6A, when the resistor R1 is provided as the variable resistor, the value of the resistor R1 is changed to be greater than the value at room temperature so as to increase the ΔV voltage. In a manner like the above, the ΔV voltage generator 420*a* of FIG. 6B and FIG. 6C can set the ΔV voltage to a desired voltage by controlling a ratio of the resistors R1 and R1 so as to increase the collector-emitter voltage $V_{CE}$=ΔV when the temperature of the plasma display device is high. In this case, the ratio of the resistors R1 and R2 can be controlled by a value of at least one of the resistors R1 and R2 according to the control signal of the controller 200. Herein, the ratio of the resistors R1 and R2 is a relative size of the resistor R1 to the size of the resistor R2, the ratio of the resistors R1 and R2 at the high temperature is greater than that of the resistors R1 and R2 at room temperature.

As described, when the temperature of the plasma display device is a high temperature, the ΔV voltage can be set to be greater than at room temperature by controlling a resistance of least one of the resistors R1 and R2 according to the control signal of the controller 200. Therefore, the wall charges can be controlled to be erased less during the falling period of the reset period so as to perform a proper address operation in the next address period. That is, the low discharge can be reduced or prevented from being generated.

Although the transistor Q1 is provided as the bipolar transistor in the first exemplary embodiment of the present invention, the transistor Q1 can be replaced with a metal oxide semiconductor field effect transistor (hereinafter referred to as a MOSFET) or an insulated gate bipolar transistor (hereinafter referred to as an IGBT). This will be described in further detail with reference to the FIG. 7 and FIG. 8.

Figure 7:
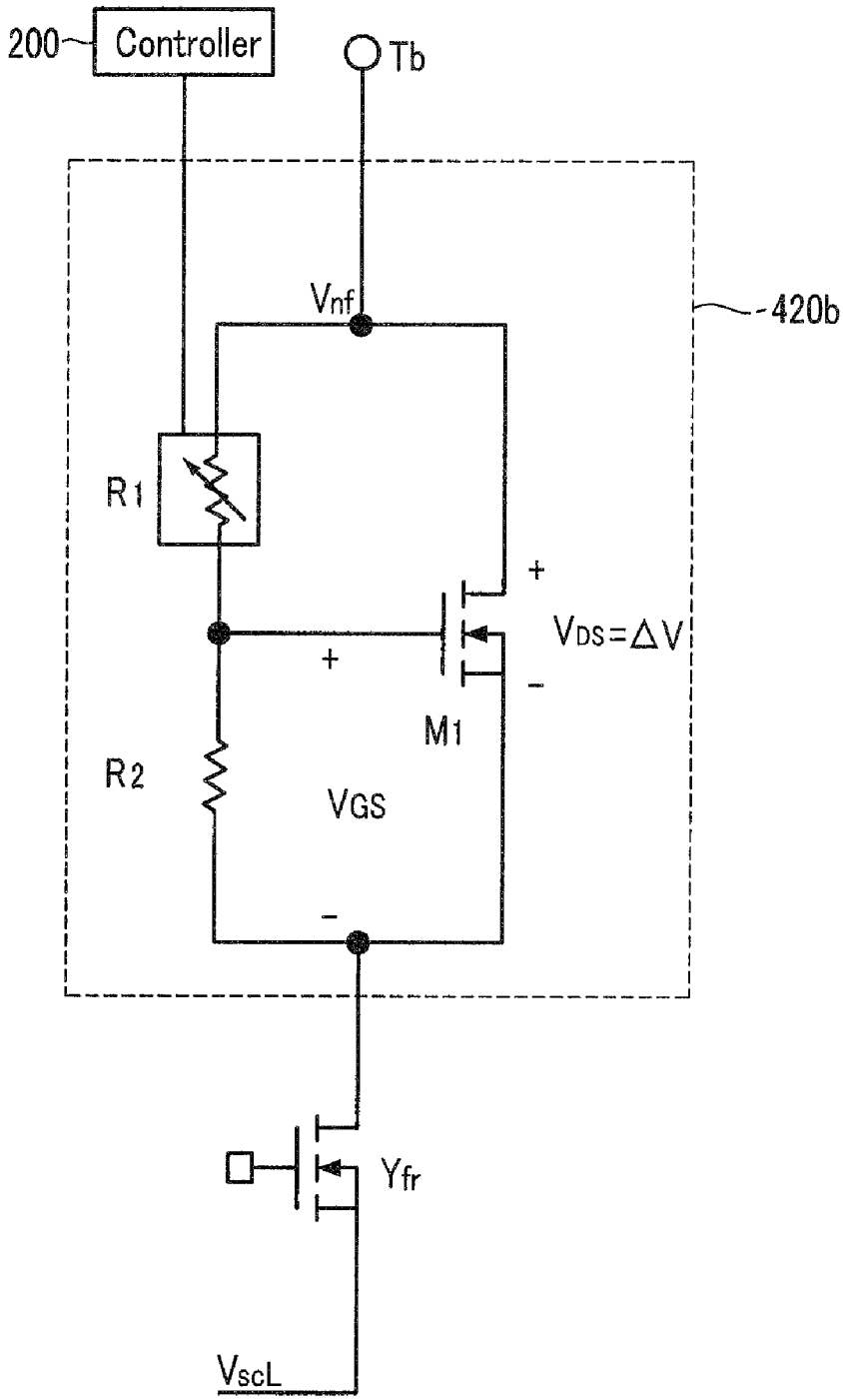
FIG. 7 is a simplified schematic diagram of a ΔV voltage generator according to a second exemplary embodiment of the present invention.

FIG. 7 is a simplified schematic diagram of a ΔV voltage generator 420*b* according to a second exemplary embodiment of the present invention.

As shown in FIG. 7, the ΔV voltage generator 420*b* of the second exemplary embodiment is substantially the same as that of the first exemplary embodiment, except that a transistor M1 is provided as a MOSFET, and thus repeated descriptions will be omitted.

In the ΔV voltage generator 420*b* according to the second exemplary embodiment of the present invention, the transistor M1 is replaced with the MOSFET, and therefore a drain-source voltage $V_{DS}$ (i.e., ΔV voltage) of the transistor M1 can be obtained as given in Equation 3.

$$V_{DS}=(1+R1/R2)*V_{GS} \quad \text{Equation 3}$$

In Equation 3, the $V_{GS}$ denotes a gate-source voltage of the transistor M1. As shown in Equation 3, when the transistor M1 is replaced with the MOSFET, the base-emitter voltage $V_{BE}$ of the transistor Q1 of Equation 2 is replaced with the gate-source voltage $V_{GS}$ of the transistor M1.

The ΔV voltage generator 420*b* according to the second exemplary embodiment of the present invention also can control a ΔV voltage by using the gate-source voltage $V_{GS}$ and the resistors R1 and R2 as shown in Equation 3.

In addition, in the ΔV voltage generator 420*b* according to the second exemplary embodiment of the present invention, at least one of the resistors R1 and R2 is provided as a variable resistor that has a resistance that varies according to a control signal of a controller 200 as in the first exemplary embodiment of the present invention. That is, when the temperature of the plasma display device is high, the ΔV voltage generator 420*b* receives the control signal from the controller 200 and controls a resistance of at least one of the resistors R1 and R2 so as to increase the ΔV voltage.

Figure 8:
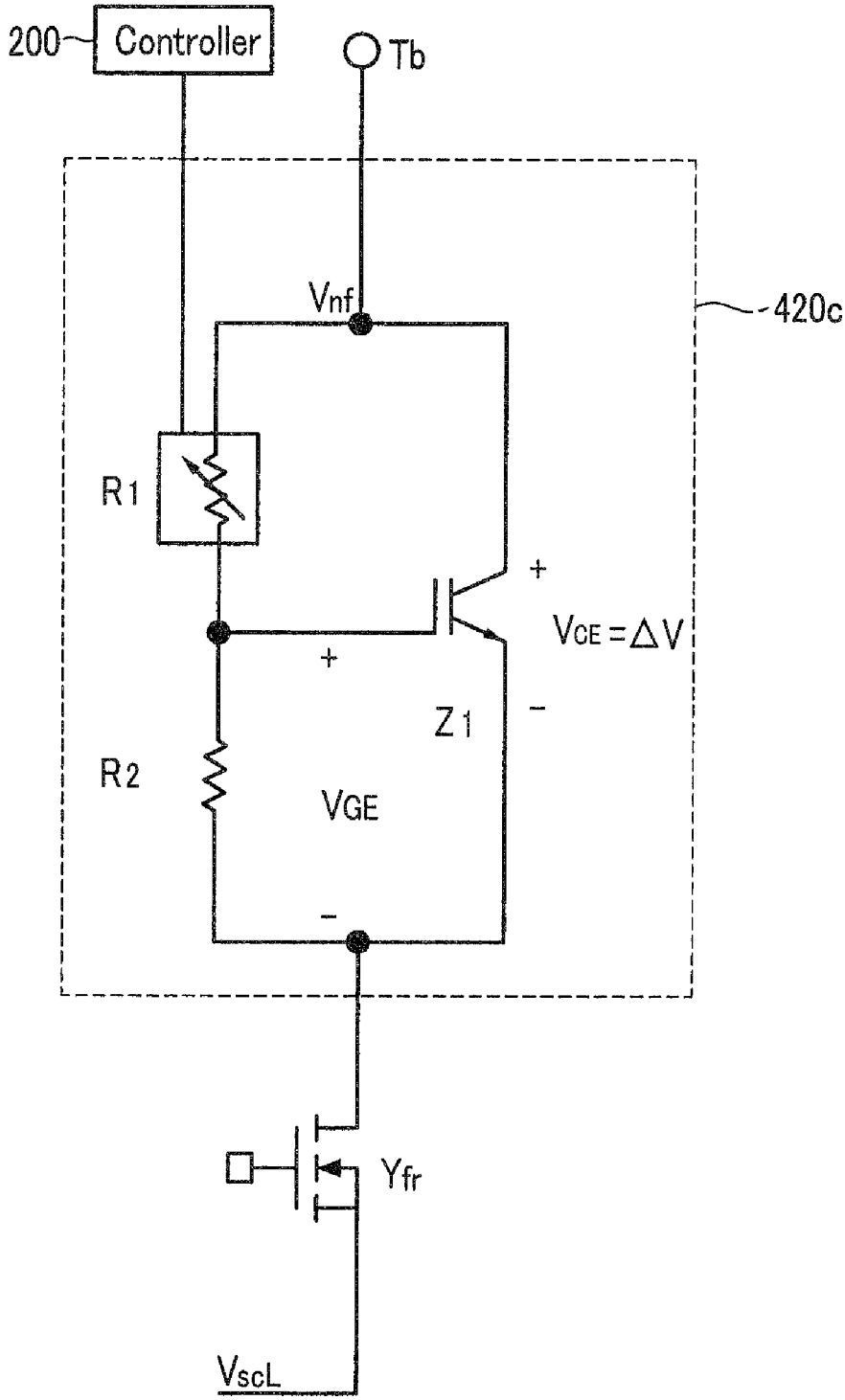
FIG. 8 is a simplified schematic diagram of a ΔV voltage generator according to a third exemplary embodiment of the present invention.

FIG. 8 is a simplified schematic diagram of a ΔV voltage generator 420*c* according to a third exemplary embodiment of the present invention.

As shown in FIG. 8, the ΔV voltage generator 420*c* according to the third exemplary embodiment of the present invention is substantially the same as that of the first exemplary embodiment of the present invention, except that a transistor Z1 that replaces the transistor Q1 is an IGBT, and thus repeated descriptions will be omitted.

In the ΔV voltage generator 420*c* according to the third exemplary embodiment of the present invention, since the transistor Z1 is an IGBT unlike the first exemplary embodiment, a collector-emitter voltage $V_{CE}$ of the transistor Z1 can be obtained as given in Equation 4.

$$V_{CE}=(1+R1/R2)*V_{GE} \quad \text{Equation 4}$$

In Equation 4, $V_{GE}$ denotes a gate-emitter voltage of the transistor Z1. As shown in Equation 4, when the transistor Z1 is an IGBT, the base-emitter voltage $V_{BE}$ of the transistor Q1 of Equation 2 is replaced with the gate-emitter voltage $V_{GE}$ of the transistor Z1.

As described, the ΔV voltage generator 420*c* according to the third exemplary embodiment of the present invention also can control the ΔV voltage by using the gate-emitter voltage $V_{GE}$ of the transistor Z1 and values of the resistors R1 and R2 as shown in Equation 4.

In addition, in the ΔV voltage generator 420*c* of the third exemplary embodiment of the present invention, at least one of the resistors R1 and R2 can be provided as a variable resistor that has a resistance that varies according to a control signal of a controller 200 as in the first exemplary embodiment of the present invention. That is, when the temperature of the plasma display device is high, the ΔV voltage generator 420*c* receives the control signal from the controller 200 and controls a resistance of at least one of the resistors R1 and R2 so as to increase the ΔV voltage.

In addition, a constant voltage (i.e., ΔV voltage) can be generated by using the ΔV voltage generators 420*a*, 420*b*, and 420*c* according to the first to third exemplary embodiments of the present invention so that the Vnf voltage can be generated by using one power source (i.e., VscL power source).

In the first to third exemplary embodiments of the present invention, it is assumed that the base-emitter voltage $V_{BE}$ of the transistor Q1, the gate-source voltage $V_{GS}$ of the transistor M1, and the gate-emitter voltage $V_{GE}$ of the transistor Z1 have fixed values. However, in general, it is assumed that the base-emitter voltage $V_{BE}$ of the transistor Q1, the gate-source voltage $V_{GS}$ of the transistor M1, and the gate-emitter voltage $V_{GE}$ of the transistor Z1 are decreased as the temperature is increased. In this case, referring to Equation 2, Equation 3, and Equation 4, the ΔV value can set to be increased by controlling a ratio of resistors of each of the ΔV voltage generators 420*a*, 420*b*, and 420*c* when the temperature of the plasma display device is high.

In addition, the ratio of resistances of the resistors of the ΔV voltage generator can be varied by a control signal according to temperature so as to increase the ΔV voltage at a high temperature, thereby reducing or preventing a low discharge from being generated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims and their equivalents.

What is claimed is:

1. A plasma display device comprising:

a plasma display panel (PDP) having a first electrode;

a temperature detector for detecting a temperature of the PDP;

a driver for applying a driving voltage to the first electrode; and a controller for generating a control signal to control the driver according to the temperature detected by the temperature detector, wherein the driver comprises:

a first transistor coupled between the first electrode and a first power source for supplying a scan voltage to the first electrode;

at least one first resistor coupled between the first electrode and a control electrode of the first transistor;

at least one second resistor coupled between the control electrode of the first transistor and the first power source; and a second transistor coupled between the first transistor and the first power source, the second transistor being adapted to gradually decrease a voltage of the first electrode to a reset minimum voltage when the second transistor is turned on during a reset period, wherein at least one of the first resistor or the second resistor is a variable resistor having a resistance that varies according to the control signal of the controller, and wherein the controller is configured to set resistances of the at least one of the first resistor or the second resistor to control a voltage difference between the reset minimum voltage and the scan voltage to be approximately equal to a first voltage when the temperature of the PDP is less than a reference temperature, and to set the resistances of the at least one of the first resistor or the second resistor to control the voltage difference between the reset minimum voltage and the scan voltage to be approximately equal to a second voltage that is greater than the first voltage when the temperature of the PDP is greater than the reference temperature.

2. The plasma display device of claim 1, wherein the controller is configured such that when the temperature of the PDP is greater than the reference temperature, the controller outputs a control signal to set a relative resistance of the first resistor relative to the second resistor to be greater than that when the temperature of the PDP is less than the reference temperature.

3. The plasma display device of claim 2, wherein the reset minimum voltage is greater than the scan voltage.

4. The plasma display device of claim 3, further comprising a third transistor coupled between the first electrode and the first power source, wherein the scan voltage is applied to the first electrode when the third transistor is turned on.

* * * * *